United States Patent [19]

Otani et al.

[11] Patent Number: 4,749,986

[45] Date of Patent: Jun. 7, 1988

[54] COLLECTING PROCESS OF FIRE DATA AND FIRE DETECTOR USING THE PROCESS AND FIRE ALARM SYSTEM ALSO USING THE PROCESS

[75] Inventors: Shigeru Otani, Hiratsuka; Hiromitsu Ishii, Chiba; Takashi Ono, Yokohama, all of Japan

[73] Assignee: Hochiki Corporation, Tokyo, Japan

[21] Appl. No.: 849,037

[22] Filed: Apr. 7, 1986

[30] Foreign Application Priority Data

Apr. 12, 1985 [JP] Japan ..... 60-78074

[51] Int. Cl.[4] ..... G08B 17/00

[52] U.S. Cl. ..... 340/587; 340/511; 364/178

[58] Field of Search ..... 340/587, 578, 511; 364/178, 551, 557

[56] References Cited

U.S. PATENT DOCUMENTS 4,644,331 2/1987 Matsushita et al. ..... 340/587

*Primary Examiner*—Joseph A. Orsino
*Assistant Examiner*—Thomas J. Mullen, Jr.
*Attorney, Agent, or Firm*—Lackenbach Siegel Marzullo & Aronson

[57] ABSTRACT

A process for detecting a change in the physical phenomena caused by a fire in an analog form, periodically sampling the analog detection data, calculating moving average values of the time series sampling data for filtering, and establishing the sampling period and the number of smoothing data provided for the moving average calculation so that a cut-off frequency of the filtering is established which is coincident with the maximum frequency of the main frequency components of the analog detection data. The invention also relates to a fire detector and a fire alarm system for carrying out such a process.

14 Claims, 7 Drawing Sheets

COLLECTING PROCESS OF FIRE DATA AND FIRE DETECTOR USING THE PROCESS AND FIRE ALARM SYSTEM ALSO USING THE PROCESS

FIELD OF THE INVENTION AND RELATED ART

This invention relates to a process collecting in an analog form, data concerning a physical change of a phenomenon caused by a fire and for making a fire determination on the basis of the analog detection data. It also relates to a fire detector using the process and a fire alarm system also using the process.

Recently, there has been developed, after many studies, an analog type fire alarm system in which analog detectors each having a detecting section are adapted to detect, in an analog form, a change of physical phenomena, such as a smoke density, a temperature, etc. caused by a fire. A central signal station is adapted to receive the analog detection data from the analog detectors and to make a fire determination on the basis thereof.

In such an analog type fire alarm system, a plurality of analog detectors for detecting a change in the physical phenomena are connected to a signal line derived from the central signal station and the analog detectors are sequentially called with a predetermined samping period according to a polling system so that the central signal station may collect the analog detection data from the respective analog detectors. More particularly, a plurality of analog detectors sequentially return, with time lags, the respective analog detection data to a single central signal station.

Therefore, the central signal station receives, in a time-division manner, the analog detection data from the respective analog detectors. In order to collect such analog detection data, which are separately returned from the respective analog detectors, as many as possible within a unit time, the sampling period for each of the analog detectors is shortened as much as possible and the analog detection data of each of the analog detectors are collected. The analog detection data obtained by such sampling are further subjected to moving average calculation and/or simple average calculation, so that fire determination may be made on the basis of the data processed by the moving average calculation and/or simple average calculation.

However, such a fire alarm system in which the sampling period is set as short as possible involves some problems, although many analog detection data can be obtained from each of the analog detectors within a unit time.

Stated more particularly, the central signal station receives, as data, noise components mixed in at the time of detection operation by the respective analog detectors and at the time of transmission of the analog detection data following such detection operation, together with real signal components representing changes in the physical phenomena such as a smoke density, a temperature, etc. caused by a fire. The central signal station, then, processes the data containing the noise components in addition to the signal components, so that it takes a considerable time to make fire determination or there is even a possibility of mis-determination of a fire condition if the noise components are significant.

SUMMARY OF THE INVENTION

It is therefore an object of the present invention to provide a data collecting process which is capable of effectively removing noise components mixed in the respective analog detection data such as smoke detection data, temperature detection data, etc. and capable of accurately determining fire conditions on the basis of real signal components. The invention also provides a fire detector and a fire alarm system both using the process.

To attain this object, the data collecting process of the present comprises detecting a change in the physical phenomena caused by a fire in an analog form, sampling the analog detection data, and calculating moving average values of the time series sampling data for filtering. The sampling period and the number of smoothing data provided for the moving average calculation are established so that a cut-off frequency of the filtering is coincident with the maximum frequency of the main frequency components of the analog detection data.

The fire detector of the present invention comprises a detecting section for detecting, in an analog form, a change in the physical phenomena caused by a fire and outputting the analog detection data, a filter including a sampling section for sampling the analog detection data, a calculating section for calculating moving average values of the time series sampling data output from the sampling section, and a control section, for controlling a sampling period of the sampling section and the number of smoothing data provided for the moving average calculation so that a cut-off frequency of the filter is coincident with the maximum frequency of the main components of the frequency analog detection data.

The fire alarm system of the present invention comprises a signal station having at least one detecting section for detecting, in an analog form, a change in the physical phenomena caused by a fire and outputting the analog detection data. The signal station having a filter which includes a sampling section for sampling the analog detection data, a calculating section for calculating moving average values of the time series sampling data output from the sampling section, and a control section for controlling a sampling period of the sampling section and the number of smoothing data provided for the moving average calculation so that a cut-off frequency of the filter is coincident with the maximum frequency of the main frequency components of the analog detection data.

The present invention enables effective receiving and processing of the smoke detection data and the temperature detection data, respectively, and can much improve the reliability of the fire alarm system.

PREFERRED EMBODIMENT OF THE PRESENT INVENTION

Figure 1:
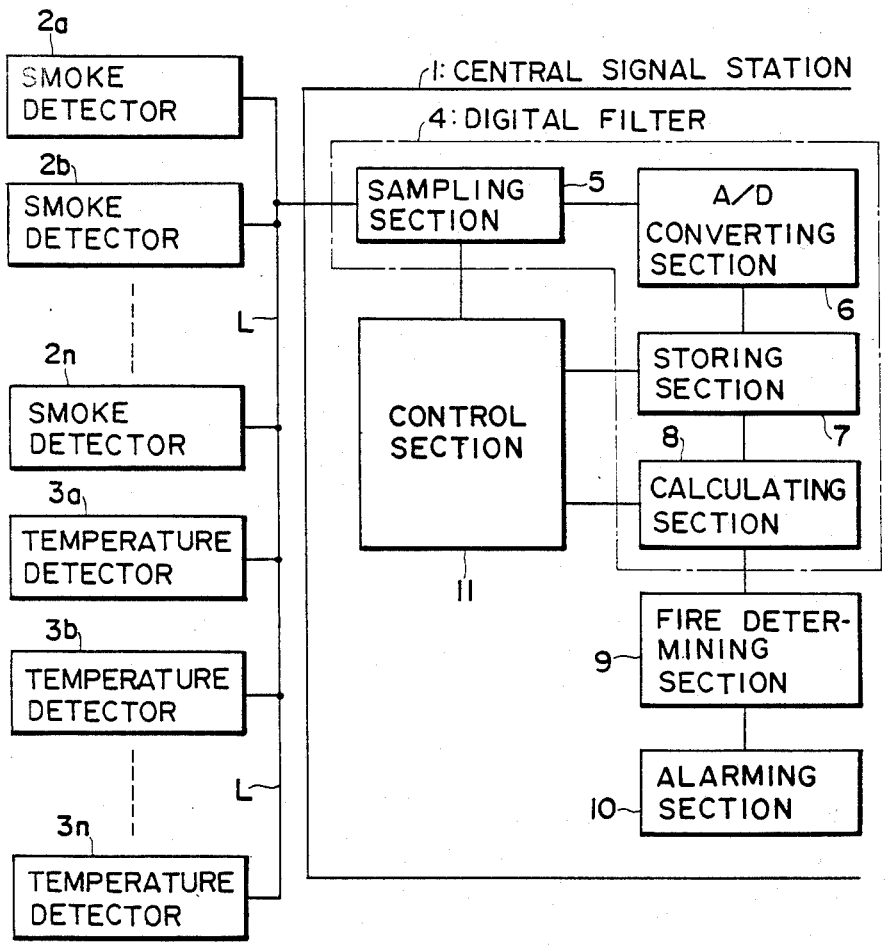
FIG. 1 is a block diagram of an entire construction of the present invention.

A preferred embodiment of the present invention will now be described, referring to the drawings.

At the outset, experimental results on which the present invention is based will be explained referring to FIG. 7.

Figure 7:
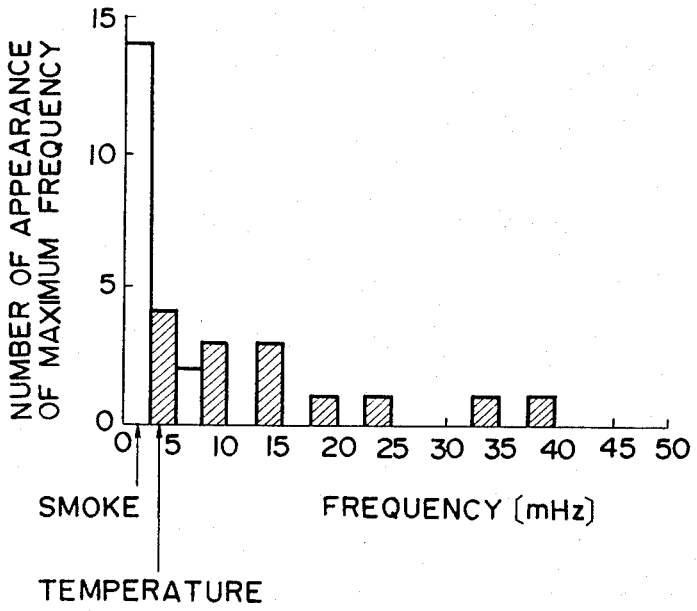
FIG. 7 is the graph showing a distribution of the number of times in which the maximum frequency of the main components appears among the changing frequency components of the smoke density and temperature detection data in the early stage of a fire.

FIG. 7 relates to the smoke density data and the temperature data at an early stage of a fire and shows the number of appearances of the maximum frequency of the main component among the frequency components of the respective data. More specifically, the ordinate indicates the number of times and the abscissa indicates the frequency (mHz). The smoke is denoted by a white bar and the temperature is denoted by a shadowed bar at intervals of 5 mHz.

Various fire experiments have been conducted and the analog detection data of the smoke and the temperature at the early stage of a fire have been analyzed. The results of the analysis reveal that, in the case of smoke, the maximum frequency of the frequency components containing noise components is 35 mHz and the maximum frequency of the main components from which the noise components have been eliminated is 10 mHz as can be seen from FIG. 7. In the case of temperature, the maximum frequency of the frequency components containing the noise components is 180 mHz and the maximum frequency of the main components from which the noise components have been eliminated is 40 mHz as shown in FIG. 7. However, the maximum frequency of the main components will vary in accordance with the condition or size of the room where the experiments were conducted and it may be higher than that shown in FIG. 7 when such other circumstances are taken into consideration. Therefore, the maximum frequency of the main components is estimated to be 20 mHz in the case of smoke and to be 60 mHz in the case of temperature.

In the embodiment of the present invention as will be described hereinafter, the cut-off frequency of a filter is determined by using a sampling period and a number of the sampling data to be provided for moving average calculation such that the cut-off frequency coincides with the maximum frequency of the main frequency components of the analog data from the fire detecting section.

In FIG. 1 a complete form of an embodiment of the present invention is shown.

A central signal station 1 receives a power from a supply/signal line L. A plurality of smoke detectors *2a, 2b, . . . 2n* each have a smoke detecting section for detecting, in an analog form, a change in the smoke density caused by a fire, and a plurality of temperature detectors *3a, 3b, . . . 3n* each have a temperature detecting section for detecting, in an analog form, a change in the temperature due to a fire. They are connected to the power supply/signal line L.

The plurality of smoke detectors *2a, 2b, . . . 2n* and the plurality of temperature detectors *3a, 3b, . . . 3n* are preliminarily alloted with their own address numbers, respectively, and they sequentially return analog detection data to the central signal station in response to sequential calling from the central signal station. More specifically, each of the smoke detectors *2a, 2b, . . . 2n* includes a window comparator for detecting a pulse voltage of an amplitude V2 and a pulse counter for counting the pulse outputs from the window comparator. Each smoke detector counts the calling pulses from the central signal station 1 and when the number of the pulse counts becomes coincident with the respective address number, it returns the smoke detection data in the mode of current to the central signal station 1 during an idle time, i.e., the interval between the calling pulses. Similarly, each of the plurality of temperature detectors *3a, 3b, . . . 3n* includes a window comparator for detecting a pulse voltage of an amplitude V3 and a pulse counter for counting the pulse outputs from the window comparator and thereby count the calling pulses of the pulse voltage V3 from the central signal station. When the count number of the pulses becomes coincident with the respective address number, each of the temperature detectors returns the temperature detection data in the mode of current during an idle time of the interval between the calling pulses. In this regard, it is to be noted that the response of each of the smoke detectors *2a, 2b, . . . 2n* is set higher than the cut-off frequency fcs of the smoke density data as will be described in detail later, and the response of each of the temperature detectors *3a, 3b, . . . 3n* is set higher than the cut-off frequency fch of the temperature data.

The inner structure of the central signal station 1 will now be described.

The central signal station 1 comprises a digital filter 4, a control section 11 for controlling the digital filter 4, a fire determining section 9 for determining a fire on the basis of the processed data from the digital filter 4 and an alarming section 10 for giving a fire alarm in response to an instruction from the fire determining section 9. The digital filter 4 includes a sampling section 5, an A/D converting section 6, a storing section 7 and a calculating section 8.

The sampling section 5 transmits, every period of Ts seconds, in response to an instruction from the control section 11, calling pulses of voltage V2 to the smoke detectors *2a, 2b, . . . 2n* and transmits, every period of Th seconds, in response to an instruction from the control section 11, calling pulses of a voltage V3 to the temperature detectors *3a, 3b, . . . 3n*, so as to sample the smoke detection data every period of Ts seconds and the temperature detection data every period of Th seconds.

The A/D converting section 6 carries out A/D conversion of the sampling data from the sampling section 5 and the storing section 7 sequentially stores, in response to instructions from the control section 11, the A/D converted sampling data at addresses therein of the respective detectors. The calculating section 8 is input with the stored data from the storing section 7 and calculates, in response to instructions from the control section 11, a moving average of every Ns smoke density data in time sequence and a moving average of every Nh temperature data in time sequence.

The data transmission timing of the smoke detectors and temperature detectors in response to the calling pulses from the sampling section 5 will now be described, referring to FIGS. 2 and 3.

Figure 2:
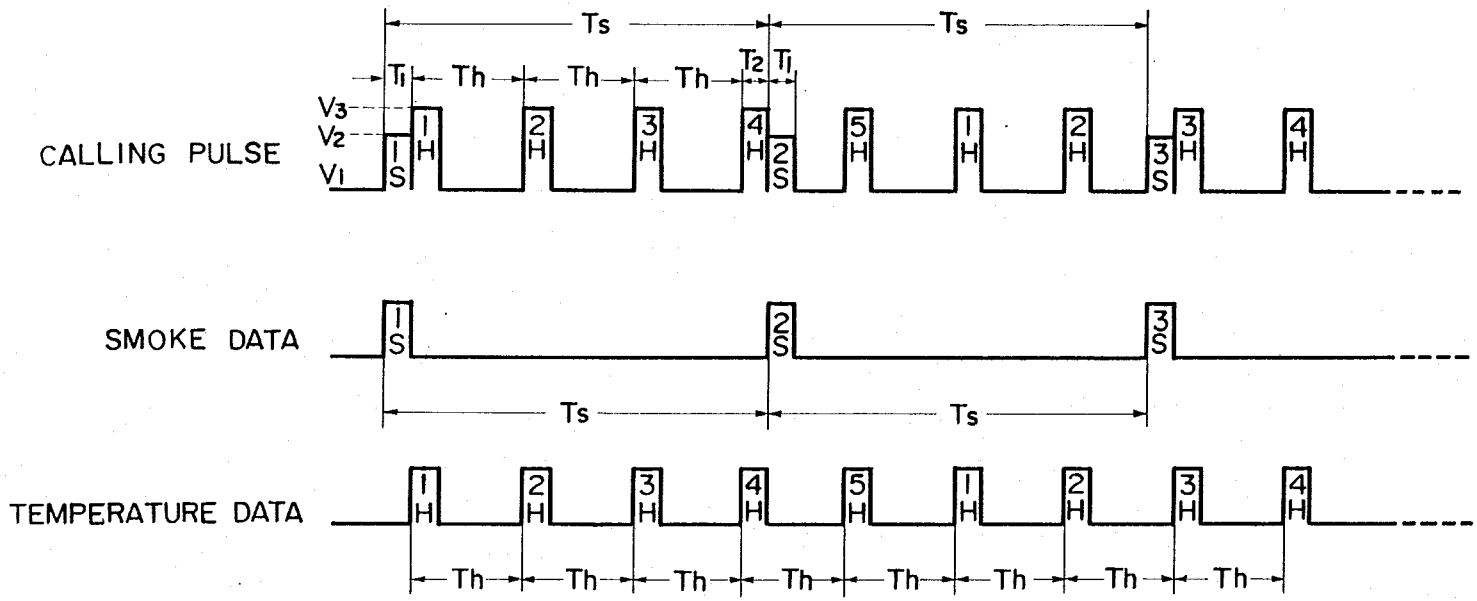
FIG. 2 is a diagram of signal waveforms showing the response of the fire detector to calling pulses from the central signal station.

As shown in FIG. 2, the sampling section 5 transmits calling pulses in response to the instruction from the control section 11 and transmits, every period of Ts seconds (for example 14 seconds), to the smoke detectors the calling pulses 1S, 2S, 3S . . . having a pulse voltage in which the voltage V2 (for example 35 V) superposed on a voltage V1 (for example 28 V). The sampling section 5 also samples the analog data from each the smoke detector *2a, 2b,* . . . *2n* sequentially, and receives the sampling data as smoke density data 1S, 2S, 3S . . . every period of Ts seconds. Similarly, the sampling section 5 transmits, every period of Th (for example 4 seconds), calling pulses 1H, 2H, 3H . . . having a pulse voltage in which the voltage V3 (for example 40 V) is superposed on the voltage V1, to the temperature detectors. The sampling section 5 then samples the analog data from each of the temperature detector *3a, 3b,* . . . *3n* sequentially, and receives the sampling data as the temperature data 1H, 2H, 3H . . . every period of Th seconds. The base voltage for the calling pulse, i.e., voltage V1 (for example 28 V) is applied as a power source voltage to the respective five detectors.

Figure 3:
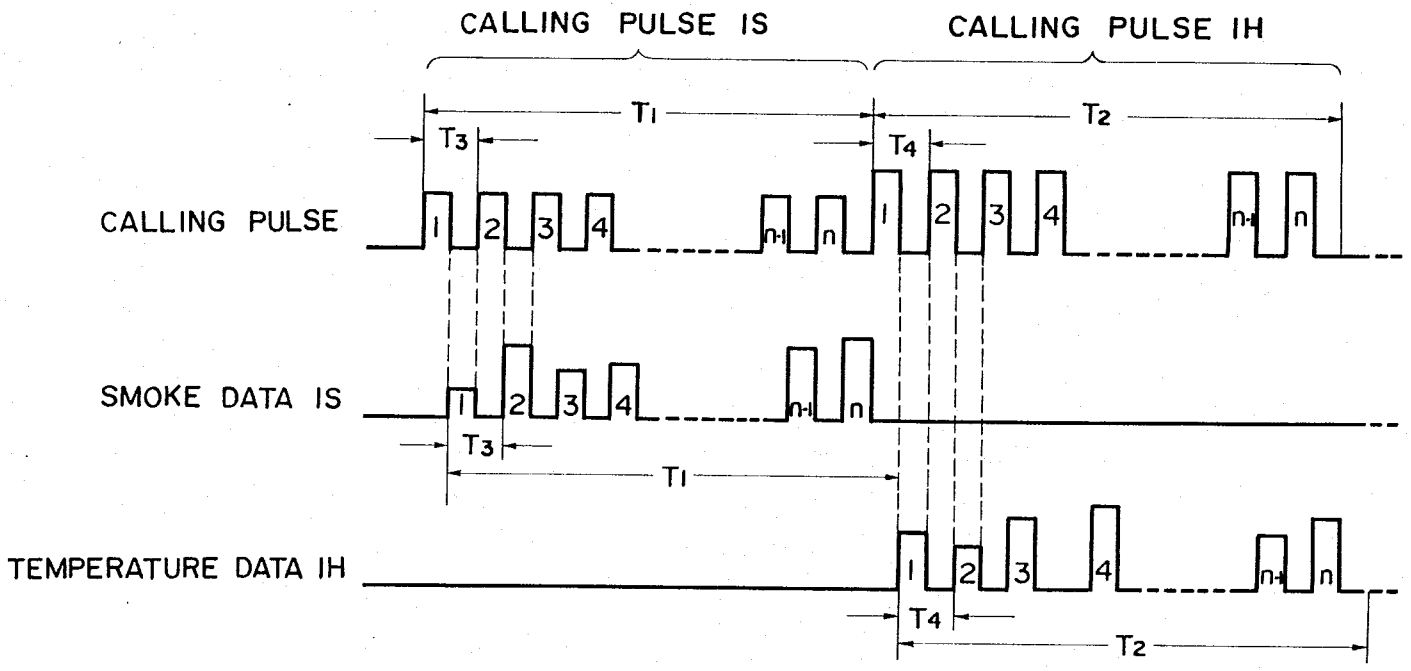
FIG. 3 is a diagram of signal waveforms showing the calling pulses in an enlarged scale and indicating the timing of the received detection data in relation with the respective calling pulses.

FIG. 3 shows in an enlarged scale the calling pulse 1S for the smoke detector and the calling pulse 1H for the temperature detector as shown in FIG. 2. FIG. 3 also shows the received timing of the smoke density data 1S and the temperature data in response to the calling pulses 1S and 1H, respectively. As shown in FIG. 3, the calling pulses 1S for the smoke detectors *2a, 2b,* . . . *2n* are as many as the number of the smoke detectors installed (for example 100) and are transmitted every period of T3 (for example every 10 ms). More particularly, the calling pulses are transmitted during a calling time T1 for the smoke detectors *2a, 2b,*

$$\left.\begin{aligned} T1 &= T3 \times 100 \\ &= 10\ (\text{ms}) \times 100 \\ &= 1000\ (\text{ms}) \\ &= 1\ (\text{s}) \end{aligned}\right\} \quad (1)$$

and the smoke density detection data are received, within the idle times between the pulse intervals of the calling pulses, from the corresponding smoke detectors, respectively. Similarly, the calling pulses 1H for the temperature detectors *3a, 3b,* . . . *3n* are as many as the number of the temperature detectors installed (for example 100) and are transmitted every period of T4 (for example every 10 ms). More particularly, the calling pulses are transmitted during a calling time T2 for the temperature detectors *3a, 3b,* . . . *3n* as given by:

$$\left.\begin{aligned} T2 &= T4 \times 100 \\ &= 10\ (\text{ms}) \times 100 \\ &= 1000\ (\text{ms}) \\ &= 1\ (\text{s}) \end{aligned}\right\} \quad (2)$$

and the temperature detection data are received, within the idle times between the pulse intervals of the calling pulses, from the corresponding smoke detectors, respectively.

The function of the digital filter 4, i.e., the relationship between the sampling periods Ts, Th of the sampling section 5 and the numbers of smoothing data Ns, Nh will now be described. The smoothing data number Ns is time series data concerning the smoke density data stored in the storing section 7 and is provided for the moving average calculation by the calculating section 8, whereas the smoothing data number Nh is time series data concerning the temperature data among the data stored in the storing section 7.

Figure 4:
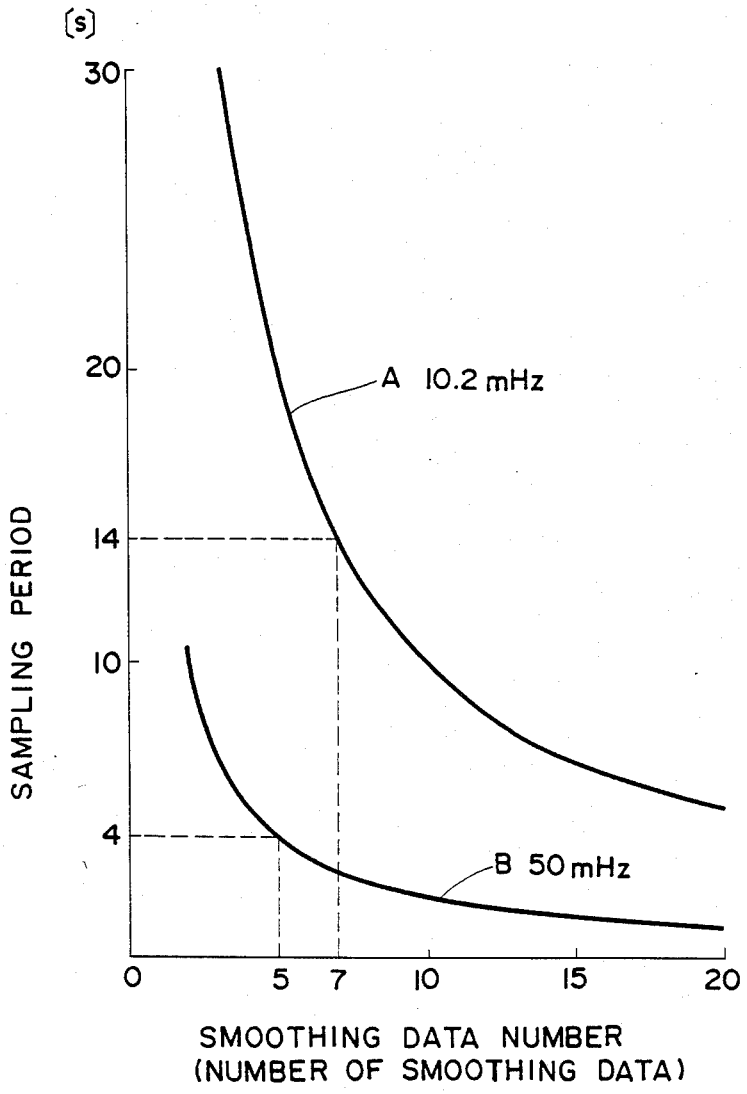
FIG. 4 shows graphs of the relationship between the number Ns of smoothing data provided for the moving average calculation and the sampling period Ts when the cut-off frequency for the smoke detection data is set at 10.2 mHz, and the relationship between the number Nh of smoothing data provided for the moving average calculation and the sampling period Th when the cut-off frequency for the temperature detection data is set at 50 mHz, respectively.

In FIG. 4, curve A is a graph showing the sampling period Ts in relation with the smoothing data number Ns to be provided for the moving average calculation. In this graph, the value of $1/(Ts \times Ns)$ is set at a value (for example 0.0102 Hz) which is lower than the maximum frequency of the main components of the smoke detection, i.e., at a cut-off frequency 10.2 mHz. Curve B of FIG. 4 is a graph showing the sampling period Th in relation with the smoothing data number to be provided for the moving average calculation. In the graph, the value of $1/(Th \times Nh)$ is set at a value (for example 0.05 Hz, i.e, a cut-off frequency 50 mHz) which is lower than the maximum frequency of the main components of the temperature detection.

As apparent from the graph A for the smoke density data as shown in FIG. 4, when the value of $1/(Ts \times Ns)$ is set at 0.0102 Hz, the relationship between the sampling period Ts of the sampling section 5 and the smoothing data number Ns of the calculating section 8 is as follows. If the smoothing data number Ns is set at 7, the sampling period Ts is set to the 14 sec, and if the smoothing data number Ns is set at 5, then the sampling period Ts is set to be 19.6 sec. The value of $1/(Ts \times Ns)$ is not limited to 10.2 mHz and the sampling period Ts in relation with the smoothing data number Ns is suitably selected so that the value of $1/(Ts \times Ns)$ may be lower than 20 mHz assuming the real fire.

Similarly, as is apparent from the graph B for the temperature data as shown in FIG. 4, when the value of $1/(Th \times Nh)$ is set at 50 mHz, the relationship between the sampling period Th of the sampling section 5 and the smoothing data number Nh of the calculating section 8 is as follows. If the smoothing data number Nh is set at 5, the sampling period Th is selected to be 4 sec, and if the smoothing data number Nh is set at 3, then the sampling period Th is selected to be 6.7 sec. The value of $1/(Th \times Nh)$ is not limited to 50 mHz and the sampling period Th in relation with the smoothing data number Nh may be suitably selected so that the value of $1/(Th \times Nh)$ may be lower than 60 mHz.

Now, the operation when the value of $1/(Ts \times Ns)$ is set at 10.2 mHz for smoke and the value of $1/(Th \times Nh)$ is set at 50 mHz for the temperature will be described.

In this case, if the smoothing data number Ns for the smoke detection data from the smoke detectors *2a, 2b,* . . . *2n* is selected to be 7 from the graph shown in FIG. 4, the sampling period Ts will be 14 sec. As to the temperature detection data from the temperature detectors *3a, 3b,* . . . *3n,* if the smoothing data number Nh is set at 5 from the graph shown in FIG. 4, the sampling period Th will be 4 sec. More specifically, the sampling section 5 samples, in response to the instructions from the control section 11, the smoke detection data from the smoke detectors and the temperature detection data from the temperature detectors, during sampling periods, and outputs the sampled data to the A/D converting section 6.

The storing section 7 stores the sampling data which have been A/D converted by the A/D converting section 6 at the addresses alloted to the respective fire detectors. The calculating section 8 is input with the stored data from the storing section 7 and carries out calculation processing in response to an instruction from the control section 11. More specifically, the calculating section 8 sequentially calculates moving averages whenever seven smoke density data is continuously obtained for the respective addresses of the smoke detectors, and sequentially calculates moving averages whenever five temperature data have been obtained for the respective addresses of the temperature detectors. The calculated data are output to the fire determining section 9. The fire determining section 9 determines a fire on the basis of the processed data from the calculating section 8, and drives the alarming section 10 for giving a fire alarm.

The operation of the digital filter 4 will now be described.

The processing of the smoke detection data received from the smoke detectors will first be described.

Figure 5:
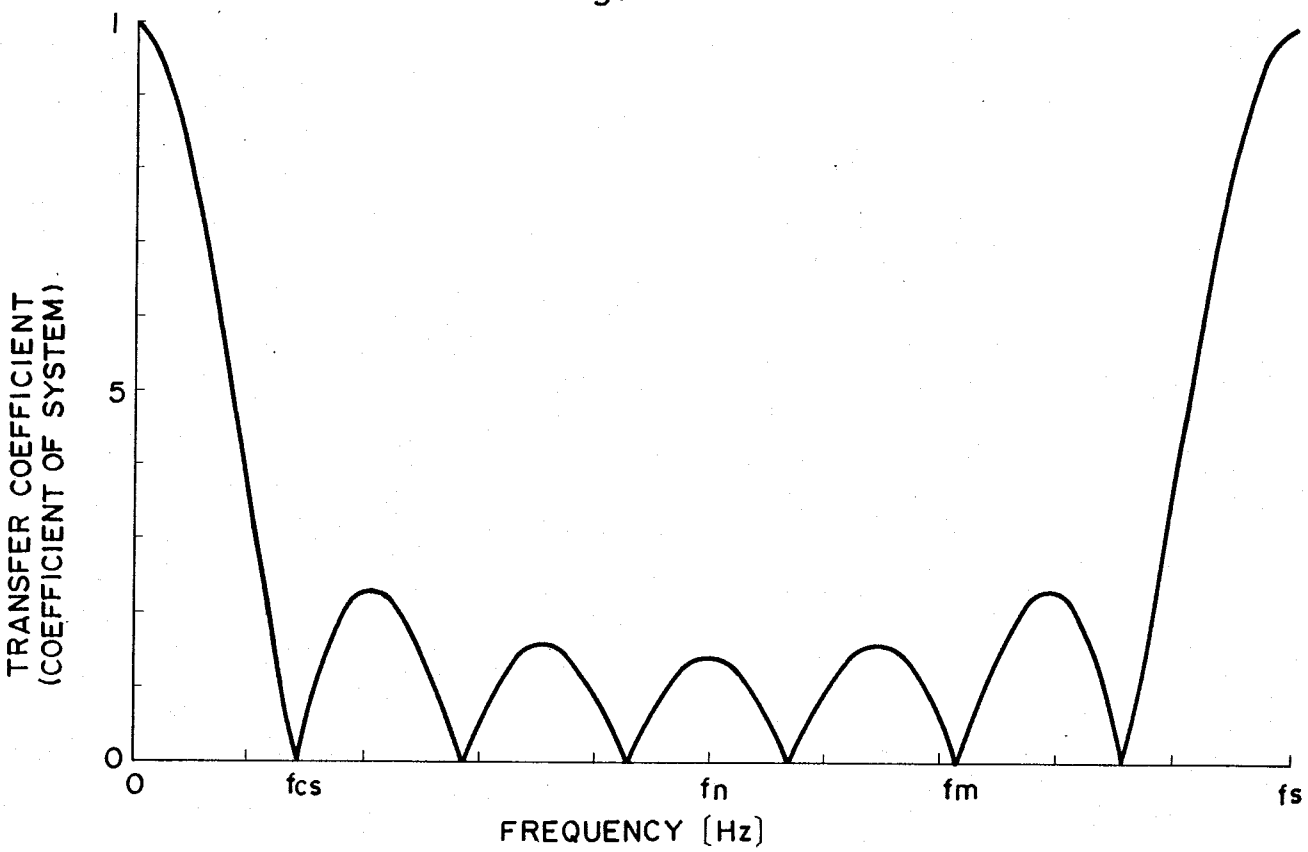
FIG. 5 is a graph showing a transfer coefficient in relation with frequency components of the smoke detection data.

FIG. 5 is a graph showing the transfer coefficient of the digital filter when the smoothing data number Ns is set to be 7 in relation with an inverse number of the sampling period Ts, i.e., sampling frequency fs.

As shown in FIG. 5, a Nyquist frequency fn for the sampling frequency fs is set as:

$$fn=(1/2)fs$$

On the other hand, the cut-off frequency fcs is shown as:

$$fcs=1/(Ts\times Ns)\ Hz$$

This cut-off frequency fcs is provided on the basis that the upper frequency of the main frequency components of the smoke density data is 20 mHz or less. Therefore, the digital filter is so arranged that the samling frequency fs, the Nyquist frequency fn, the cut-off frequency fcs of the digital filter for the moving average calculation and the maximum frequency fm of the frequency components of the smoke density data containing noise components have the following relationships:

$$\left.\begin{array}{l} fm-fn\leqq fn-fcs \\ fm>fcs \end{array}\right\} \quad (6)$$

When the above relationships of the formulae are established, noise components can be eliminated. The frequency of the main frequency components of the smoke density data is set to be 10.2 mHz. And, as can be seen from the graph of FIG. 5, the smoothing data number Ns to be provided for the moving average calculation is set to be 7 and the sampling period Ts is set to be 14 sec, i.e., the sampling frequency fs is set to be 71.43 mHz. In this case, data having frequency components higher than the cut-off frequency fsc of the digital filter which are noise components will be cut off from the frequency components of the smoke density data detected by the smoke detectors 2a, 2b, . . . 2n. At the same time, data lower than the cut-off frequency fcs, of the main frequency components of the smoke density data due to a fire will be automatically subjected to the sampling processing. More particularly, since it is known from the results of the various fire experiments that the least upper bound of the main components of the frequency smoke density data is within a range of 20 mHz and the least upper bound of the main frequency components is within a cut-off frequency fsc, only the frequency band of the main components, i.e., of the data of the main frequency components changing with time due to a fire of the smoke density data, is automatically processed for sampling and the smoke detection data mixed with the noise components having a frequency higher than the cut-off frequency fcs is automatically cut off.

The processing of the temperature detection data received from the temperature detectors 3a, 3b, . . . 3n will now be described.

Figure 6:
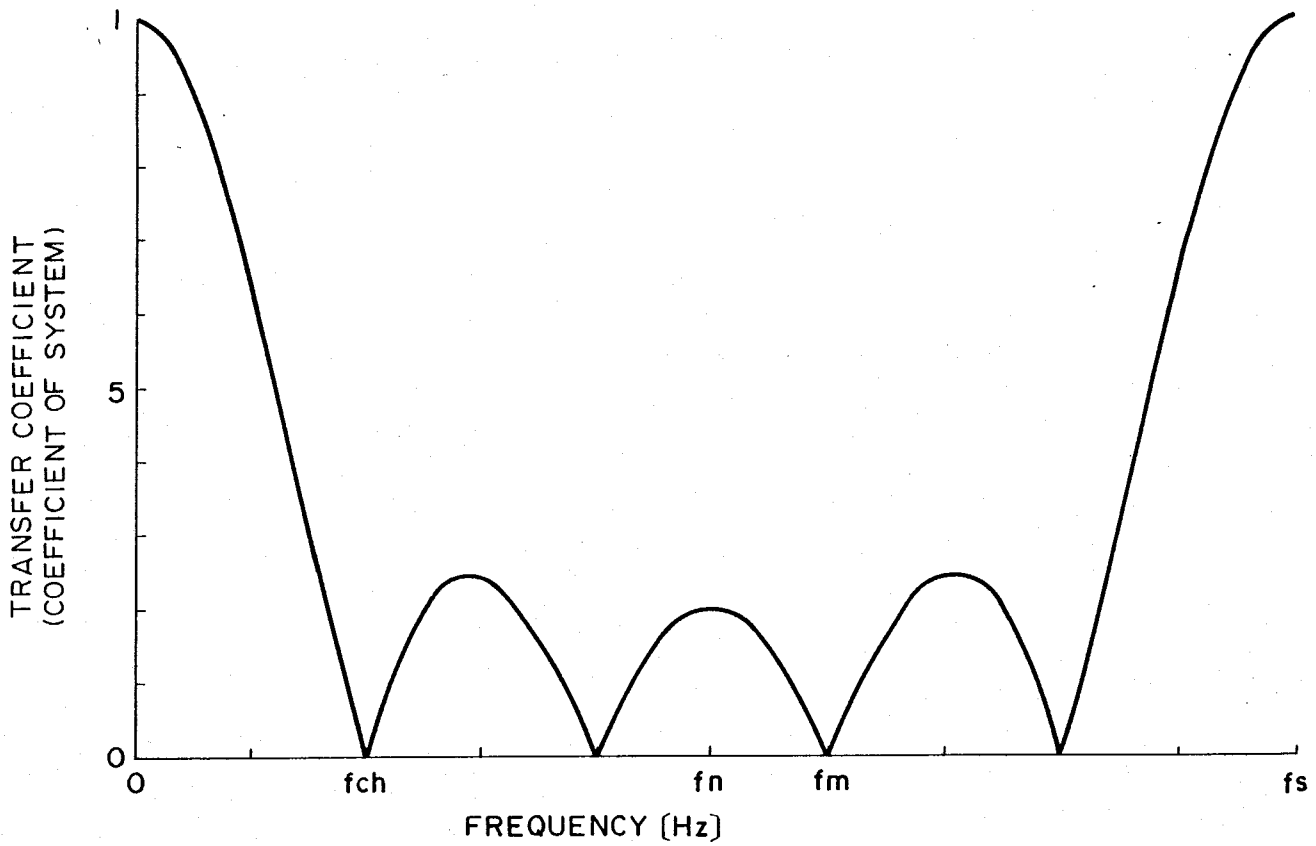
FIG. 6 is a similar graph showing a system coefficient in relation with frequency components of the temperature detection data.

FIG. 6 is a graph showing a transfer coefficient of the digital filter for the frequency components of the temperature detection data when the smoothing data number Nh is set to be 5 in relation with the inverse of the sampling period Th, i.e.; a sampling frequency fs.

As shown in FIG. 6, a Nyquist frequency fn for the sampling frequency fs is set as:

$$fn=(1/2)fs$$

On the other hand, the cut-off frequency fcs is shown as:

$$fch=1/(Th\times Nh)\ Hz$$

This cut-off frequency fcs is provided on the basis that the least upper frequency of the main components of the frequency components of the temperature data is 60 mHz or less. Therefore, the digital filter is so arranged that the samling frequency fs, the Nyquist frequency fn, the cut-off frequency fcs of the digital filter for the moving average calculation, and the maximum frequency fm of the frequency components changing with time of the temperature data containing noise components, have the following relationships:

$$\left.\begin{array}{l} fm-fn\leqq fn-fch \\ fm>fch \end{array}\right\} \quad (10)$$

When the above relationships of the formulae are established, the noise components can be eliminated. The frequency of the main frequency components of the temperature data is set to be 50 mHz. And, as can be seen from the graph of FIG. 6, the smoothing data number Nh to be provided for the moving average calculating is set to be 5 and the sampling period Th is set to be 4 sec, i.e., the sampling frequency fs is set to be 250 mHz. In this case, data having frequency components higher than the cut-off frequency fsc of the digital filter which are noise components will be cut off from the frequency components of the temperature data detected by the temperature detectors 3a, 3b, . . . 3n. At the same time, data lower than the cut-off frequency fcs of the main frequency components of the temperature data will be automatically subjected to the sampling processing. More particularly, since it has been known from the results of the various fire experiments that the least upper bound of the main frequency of the temperature data is within a range of 60 mHz as described above, and the least upper bound of the main components is within the cut-off frequency fsc, only the frequency band of the main components, i.e., the data of the main frequency components of the temperature data which change with time due to a fire is automatically processed for sampling and the temperature data mixed with the noise components having a frequency higher than the cut-off frequency fcs is automatically cut off.

In the above embodiment, a different sampling period and a different smoothing data number is established for detecting and for processing the smoke density and the temperature. However it is possible to establish the same data number of smoothing and to differ only in the sampling period (for example, in FIG. 4, the smoothing data number is set at five and the sampling period is set at about twenty seconds). In this case, the smoke detection data may be subjected to the sampling processing with the sampling period of Ts seconds and the moving average may be calculated for every Ns sampling data. Similarly, the temperature detection data may be subjected to sampling processing with a plurality of plural sampling periods of Th seconds which differs from other and the moving average may be calculated for every Nh sampling data period which are the same.

Although in the described embodiment, the sampling periods Ts or Th and the smoothing data numbers Ns or Nh for calculation of the running averages are fixedly established, variable establishment can be employed.

The fire detectors, i.e., the smoke detectors *2a, 2b,* include an A/D converting section so as to return, in response to the calling from the central signal station 1, the detection data which has been A/D converted.

Further, the digital filter and the control section are able to provide, for each of the smoke detectors and temperature detectors for filtering their analog data. In this case the data is output in reply to the calling from the central signal station. Although a digital filter of a simple moving average type is used in the foregoing embodiment, the filter may be of different types.

The fire alarm system embodying the present invention as described above has both smoke detectors *2a, 2b, . . . 2n* and temperature detectors *3a, 3b, . . . 3n,* but the fire alarm system of the present invention is not limited to this formation and it will suffice to have either smoke detectors or temperature detectors.

What is claimed is:

1. A process of collecting fire data which comprises:

detecting a change in physical phenomena caused by a fire in an analog form, sampling the analog detection data, calculating moving average values of the time series sampling data for filtering, establishing a sampling period and a number of smoothing data provided for the moving average calculation so that a cut-off frequency of the filtering is established which is coincident with the maximum frequency of the main frequency components of the analog detection data.

2. A collecting process as claimed in claim 1 in which the physical phenomena is temperature and the maximum frequency is established at 60 mHz.

3. A collecting process as claimed in claim 1 in which the physical phenomena is smoke density and the maximum frequency is established at 20 mHz.

4. A collecting process as claimed in claim 1 in which the maximum frequency is established according to the relation $$(1)\ f_m - f_n \leqq f_n - f_c$$

$$(2)\ f_m > f_c$$

where $f_m$ is the maximum frequency of the detection data, $f_n$ is the Nyquist frequency and $f_c$ is the cut-off frequency of the filter with respect to the detection data.

5. A fire detector which comprises:

a detecting section for detecting, in an analog form, a change in physical phenomena caused by a fire and outputting the analog detection data;

a filter including a sampling section for sampling the analog detection data and a calculating section for calculating moving average values of the time series sampled data output from the sampled section; and a control section for controlling the sampling period of the sampling section and the number of smoothing data provided for the moving average calculation so that a cut-off frequency of the filter is established which is coincident with the maximum frequency of the main frequency components of the analog detection data.

6. A fire detector as claimed in claim 5 in which the physical phenomena is temperature and the maximum frequency is established at 60 mHz.

7. A fire detector as claimed in claim 5 in which the physical phenomena is smoke density and the maximum frequency is established at 20 mHz.

8. A fire detector as claimed in claim 5 in which the maximum frequency is established according to the relation $$(1)\ f_m - f_n \leqq f_n - f_c$$

$$(2)\ f_m > f_c$$

wherein $f_m$ is the maximum frequency of the detection data, $f_n$ is the Nyquist frequency and $f_c$ is the cut-off frequency of the filter with respect to the detection data.

9. A fire detector as claimed in claim 5 in which in the control section the sampling period and the number of smoothing data are variably established.

10. A fire alarm system which comprises:

at least one detecting section for detecting, in an analog form, a change in physical phenomena caused by a fire and outputting the analog detection data;

a signal station having a filter which includes a sampling section for receiving and sampling the analog detection data and a calculating section for calculating moving average values of the time series sampled data output of the sampling section; and the signal station further having a control section for controlling the sampling period of the sampling section and the number of smoothing data provided for the moving average calculation so that a cut-off frequency of the filter is established which is coincident with the maximum frequency of the main frequency components of the analog detection data.

11. A fire alarm system as claimed in claim 10 in which the physical phenomena is temperature and the maximum frequency is established at 60 mHz.

12. A fire alarm system as claimed in claim 10 in which the physical phenomena is smoke density and the maximum frequency is established at 20 mHz.

13. A fire alarm system as claimed in claim 10 in which the maximum frequency is established according to the relation (1) $f_m - f_n \leqq f_n - f_c$ (2) $f_m > f_c$ wherein $f_m$ is the maximum frequency of the detection data, $f_n$ is the Nyquist frequency and $f_c$ is the cut-off frequency of the filter with respect to the detection data.

14. A fire detector as claimed in claim 10 wherein in the control section the sampling period and the number of smoothing data are variably established.

* * * * *